US008366099B2

(12) United States Patent
Cook

(10) Patent No.: US 8,366,099 B2
(45) Date of Patent: Feb. 5, 2013

(54) MEDIA RETRACTOR AND RECYCLER SYSTEM FOR AUTOMATIC DOCUMENT FEEDERS AND DUPLEXERS AND METHOD FOR USING SAME

(75) Inventor: William Paul Cook, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/028,345

(22) Filed: Feb. 16, 2011

(65) Prior Publication Data

US 2012/0205855 A1 Aug. 16, 2012

(51) Int. Cl.
*B65H 29/00* (2006.01)

(52) U.S. Cl. ..... 271/186; 271/184; 271/301

(58) Field of Classification Search ..... 271/184, 271/186, 273, 274, 303, 301
See application file for complete search history.

(56) References Cited

U.S. PATENT DOCUMENTS

| | | | | |
|---|---|---|---|---|
| 6,354,589 | B1 * | 3/2002 | Taruki et al. | 271/265.01 |
| 6,393,251 | B2 * | 5/2002 | Kono | 399/370 |
| 6,434,359 | B2 * | 8/2002 | Nose et al. | 399/374 |
| 7,410,163 | B2 * | 8/2008 | Yamanaka | 271/186 |
| 7,717,423 | B2 * | 5/2010 | Litman et al. | 271/273 |
| 2004/0120606 | A1 * | 6/2004 | Fredlund | 382/305 |
| 2009/0085280 | A1 * | 4/2009 | Litman et al. | 271/186 |
| 2011/0115146 | A1 * | 5/2011 | Shimomura et al. | 271/10.13 |

* cited by examiner

*Primary Examiner* — Kaitlin Joerger
(74) *Attorney, Agent, or Firm* — John Victor Pezdek

(57) ABSTRACT

A media retraction and recycler system for use with image processing devices such as automatic document feeders and printers that concurrently supports two media sheets for duplex printing or scanning in a partial overlapping configuration in a variable nip pressure exit roll assembly allowing use of a media path that is shorter than the total media length of the two media sheets to facilitate an increased throughput during duplex scanning or printing operations.

24 Claims, 11 Drawing Sheets

MEDIA RETRACTOR AND RECYCLER SYSTEM FOR AUTOMATIC DOCUMENT FEEDERS AND DUPLEXERS AND METHOD FOR USING SAME

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure relates generally to a media retractor and recycler system for use with automatic document feeders and duplexers, and, in particular, to a media retractor and recycler that concurrently supports two media sheets for duplex printing or scanning.

2. Description of the Related Art

A typical media feed system for automatic document feeders to allow scanning of both sides of a document employed in an all-in-one device (AIO)/multifunctional device, has a pick unit (assembly) for picking media sheets and one or more pairs of feed rolls to drive the media sheets through a feed path/loop extending to and from a scanning module of the AIO device. The pick unit and each pair of rolls from the one or more pairs of rolls around the loop are generally operated by a driving mechanism, such as a motor. The media feed system may further include a clutch mechanism adapted to engage/disengage the driving mechanism with the pick unit. Specifically, the clutch mechanism may disable picking of a media sheet by the pick unit when a previous media sheet is still in the feed path. The media feed system also includes a pair of exit rolls that may operate with the help of either the same clutch mechanism or a different clutch mechanism adapted for running/rotating each exit roll of the pair of exit rolls either in a clockwise direction or in an anti-clockwise direction. Specifically, each exit roll of the pair of exit rolls may be rotated either to drive a media sheet into an output stack or to retract the media sheet back into the feed path for duplex scanning. A similar media retractor and recycler system may be employed with a duplexing printer wherein each side of the media to be printed is directed past a print engine, such as an electrophotographic print engine or an inkjet print engine.

Typically, a media sheet is required to make three passes through a feed path in order to facilitate scanning of both sides (duplex scanning) of the media sheet and stacking of the media sheet in a collated order. The media sheet nearly completes the three passes before a next media sheet is picked-up, as the length of the media feed path is designed to hold only one media sheet at a designed for length. For instance if A4 (210 mm×297 mm) and 8½×11 inch media types are to be scanned the length of the feed path would be at least 297 mm to accommodate the longer of the two media types. FIG. 1 illustrates a typical media feed path for a duplex scanner designed to hold a single media sheet at a time for image processing.

FIG. 1 shows a media path of an imaging device 100, such as automatic document feeder (ADF) and an image processor B, such as scanner 192 for an AIO device (imaging device). As shown in FIG. 1, imaging device 100 includes a pick assembly 110 having a pick roll 112; a drive roll 119, two feed roll assemblies 120, 130 to drive a media sheet 114 positioned in input area 116 around a first media path 140 (feed path); a diverter structure, such as gate 150; and an exit roll assembly 160 that rotates bi-directionally or is reversible. Roll assemblies 120, 130, and 160 each includes a pair of rolls forming a nip therebetween. One roll or both rolls in each roll assembly may be driven. The pair of rolls in each of feed roll assemblies 120, 130 and exit roll assembly 160 form respective nips 120N, 130N, and 160N. Exit roll assembly 160 may be driven in an exit direction E and it may be reversibly driven in a retraction direction R and may employ a mechanism as is known in the art to vary the height of nip 160N as one means of varying nip pressure. As is known through use of linkages and transmissions, a motor 170 drives or rotates drive roll 119 and feed roll assemblies 120, 130 to enable media sheet feeding along first media path 140. Similarly, a second motor 172 and clutch 182 are shown for driving pick assembly 110 and pick roll 112 for picking a media sheet and feeding it into first media path 140. A third motor 173 is shown for driving exit roll assembly 160. While three motors 170, 172, 173 are illustrated, it will be recognized that a single motor may be used in place of motors 172 and 173 along with use of clutch 182 or use of an optional clutch 184 shown in dashed lines or use of both clutches 182, 184.

Media 114 exiting exit nip 160N is retained in output area 118. For duplexing, a second media path 142 (return path) is provided beginning at an intersection 144 with first media path 140 near exit roll assembly 160 and ending adjacent the start of media path 140 at an intersection 146 with first media path 140. The diverter structure, gate 150, is positioned at intersection 144 and is used to divert a media sheet being retracted by exit roll assembly 160 into second media path 142. First media path 140 begins adjacent pick roll 112 and extends to exit assembly 160, passing through feed roll assemblies 120, 130 and processing zone A and continues to intersection 144. First and second media paths 140 and 142 may be viewed as overlapping in the region between the diverter structure, gate 150 and exit roll assembly 160. Alternatively second media path 142 may be viewed as starting at intersection 144. Controller 190 is illustrated as being communicatively coupled to motors 170, 172, 173, gate 150, and various media position sensors, such as sensors S1-S3, which coupling is not shown for clarity, to control movement of media 114 along first media path 140 from input area 116 through output area 118 and along media return path 142. Sensors S1-S3 typically sense the leading and trailing edges of each media sheet as it travels along first and second media paths 140, 142. Diverter structure such as gate 150 and reversible exit roll assembly 160 comprise a media retractor and recycler assembly 200.

During a typical duplex scan, motor 170 rotates the drive roll 119, feed roll assemblies 120, 130 and exit roll assembly 160. Subsequently, motor 172 engages clutch 182 which engages pick assembly 110 causing pick roll 112 to pick a first media sheet 114-1 and driving it into first media path 140 to drive roll 119 from media stack 114 until first media sheet 114-1 reaches and is engaged by a first feed roll assembly, namely feed roll assembly 120. Either motor 172 is stopped or clutch 182 disengages from pick assembly 110 to prevent picking a subsequent media sheet. Drive roll 119 allows short media such as A6 media to be driven through the system. Should sensor S1 not detect the leading or trailing edge of first media sheet 114-1 and any subsequent media sheet, a fault may be declared by controller 190.

First media sheet 114-1 is then driven by feed roll assembly 120 to pass through a media processing zone A, where first media sheet may be printed or may be scanned by imaging processor B. As shown, a first side of first media sheet 114-1 is being scanned in media processing zone A by scanner 192. First media sheet 114-1 is then driven into nip 130N of feed roll assembly 130 which in turn drives it past a diverter structure, such as gate 150 that is positioned by controller 190 as shown to direct first media sheet 114-1 into nip 160N of exit roll assembly 160 where it continues to be driven in exit direction E. Once a trailing edge of first media sheet 114-1 passes diverter gate 150 as sensed by sensor S2, motor 173 stops and reverses which in turn reverses exit roll assembly 160 rotation and feeds first media sheet 114-1 in retraction direction R. Again should sensor S2 or S3 not detect the leading and trailing edge of first media sheet 114-1 and any subsequent media sheet a fault may be declared by controller 190.

Subsequently, exit roll assembly 160 retracts first media sheet 114-1 into second media path 142 (return path) that, as illustrated, forms a loop with first media path 140. Specifically, as shown controller 190 positions gate 150 so that as first media sheet 114-1 is retracted it is directed into second media path 142. Alternatively gate 150 may be passive and operated by gravity to fall across first media path 140 after a trailing edge of first media sheet 114-1 passes allowing first media sheet 114-1 to be directed into second media path 142 when retracted. Once the leading edge of first media sheet 114-1 enters 120N again, motor 172 stops, and first clutch, clutch 184, disengages allowing exit roll assembly 160 to feed media again in exit direction E. Nip 160N may be allowed to open to reduce friction on first media sheet 114-1 that is applied by exit roll assembly 160 before motor 173 stops. Subsequently, first media sheet 114-1 is driven through nip 120N and into processing zone A and a second side of first media sheet 114-1 is then scanned in media processing zone A by an image processor B, such as illustrated scanner 192. As first media sheet 114-1 is being scanned its leading edge is driven into nip 130N before its trailing edge exits nip 120N. Feed roll assembly 130 then continues driving media sheet 114-1 through processing zone A and past gate 150 which has been repositioned to its initial state and into exit roll assembly 160. If gate 150 is a gravity actuated gate, feed roll assembly 130 has sufficient force to push first media sheet 114-1 beneath gate 150 and into nip 160N. Once the trailing edge of first media sheet 114-1 passes gate 150 again motor 173 stops and changes rotation direction of exit roll assembly 160 from exit direction E to the retraction direction R. Nip 160N may be allowed to close, if open, when the trailing edge of first media sheet 114-1 as sensed by sensor S3 is between the processing zone A and feed roll assembly 130. Should only two motors be in use with motor 173 being used to control both pick mechanism 110 and exit roll assembly 160, then a clutch such as clutch 182 is used to ensure pick mechanism 110 will rotate only in a direction to feed media into first media path 140 while allowing exit roll assembly 160 to be able to rotate in both the retraction direction R or exit direction E as needed.

Exit roll assembly 160 stops when the trailing edge of first media sheet 114-1 passes by gate 150 as may be sensed using sensor S2. Motor 173 reverses, reversing exit roll assembly 160 which feeds first media sheet 114-1 fed back into second media path 142 and the first media path 140 for another time (third time). Thereafter motor 172 drives pick assembly 110 through clutch 182 to pick a subsequent media sheet after the trailing edge of first media sheet 114-1 approaches intersection 146 during the third time. First media sheet 114-1 then exits exit roll assembly 160 and is placed in output location 118, with the first side in a face-down orientation for proper collation. In this typical layout, motor 170 runs continuously, and the first and second clutches 184, 182 are disengaged from drive roll 160D of exit roll assembly 160 and pick assembly 110, respectively, while media sheets are being scanned, in order to achieve consistent media velocity during a scanning operation.

For media processing, exemplified by ADF 100, the drive and idler rolls 160D, 160N are typically designed to have a low nip force in order to allow the feed roll assembly 130 to overcome the nip force at drive and idler rolls 160D, 160N and provide a smooth motion of the media sheets at the image processing zone A, even when exit roll assembly 160 is driving a media sheets towards the output location 118. Alternatively, the height of nip 160N may be increased to avoid any interference during an image processing operation such as scanning or printing of the media sheets.

As depicted in FIG. 2, a length $L_1$ of the gate-to-gate loop formed by following second media path 142 from gate 150 through first media path and back to gate 150 is about 11.8 inches (30 cm), i.e., approximately 12 inches (30.5 cm). Accordingly, it may be possible for a longer media sheet, such as legal (35.6 cm), to have a leading edge and a trailing edge thereof in the nip 160N at the same time. Hence the need to be able to increase the height of nip 160N. Further, a distance D1 from pick roll 112 to the feed roll assembly 120 determines the shortest length of media that can be scanned, i.e., media sheets shorter than length D1 may not be scanned in a simplex scanning mode, as a subsequent media sheet may be picked before pick assembly 110 is allowed to stop. As illustrated distance D1 is about 11.7 cm which allows A6 media sheet to be fed by first providing a short edge of the media sheet. Depending on the design of the pick assembly 110, a distance D2 from the drive roll 119 to feed roll assembly 120 may be about 7.9 cm which may determine the length of media that may be used in the processing zone A, for example, for a simplex scanning or printing mode. Further, a distance D3 from exit roll assembly 160 past gate 150 to feed roll assembly 120, which as illustrated is about 14.2 cm, is a dimension that is used to determine timing in a duplex scanning or printing mode, as distance D3 determines the minimum length of a media sheet that may be handled in such modes. Furthermore, overall horizontal dimension and vertical dimension of the loop may be about 11.2 cm by 6.6 cm, respectively (exclusive of dimensions of pickup roll 112, drive roll 119; feed roll assemblies 120, 130 and exit roll assembly 160). The above-mentioned distances between the roll assemblies of the 100 may be measured from respective nips thereof.

It has been observed that a scanning mechanism of an AIO device (such as the AIO device operatively coupled with the ADF 100) is typically designed to keep up pace with speed of a base engine (i.e., base printer engine of the AIO device). However, during a simplex scanning mode, speed of media sheets in feed path of ADF (such as the ADF 100) coupled to the AIO device, is faster than that of the base printer engine with longer inter-page gaps. Further, overall duplex throughput of the base printer engine (measured in terms of sides per minute (SPM)) is typically of the order of ⅕ of the simplex throughput for the ADF, whereas, the base printer engine is often much more efficient in the duplex scanning mode with a throughput ranging from about ½ to 9/10 of the throughput during a simplex scanning mode. Such a difference in the throughputs between the ADF and the base engine causes problems in addition to the loss of throughput. Specifically, the base engine may often need to transit between a 'start' mode and a 'stop' mode while waiting for subsequent scanned images that need to be processed, thereby resulting in mismatch in timing of the operation of the base printer and the operation of the scanning mechanism. Such a time-mismatch may cause additional wear and acoustic noises and may lead to thermal problems.

An existing solution to the aforementioned problems is to use a single pass ADF that includes a second scan bar fixed within a feed path loop of the ADF, thereby allowing capturing of both sides of a media sheet in a single pass. However, employing a second scan bar increases cost. Further, such an ADF allows for generating images at a speed much faster than the processing speed of a base printer engine associated with the ADF. Accordingly, a scanner mechanism of such an ADF is often required to transit between a 'start' mode and a 'stop' mode as the base printer engine processes scanned images at a slower pace.

Accordingly, there is a need for an efficient and a cost-effective media retractor and recycler that facilitates in achieving a sufficiently high throughput during a duplex scanning or a duplex printing and facilitates in reducing inter-page gap between consecutive media sheets.

SUMMARY OF THE DISCLOSURE

In an imaging device having a first media path and a second media path, the first media path having an entrance and an exit, the entrance of the first media path adjacent media input area having a pick assembly, the exit of the first media path adjacent a media output area, the second media path intersecting the first media path at a first Y-shaped intersection adjacent the exit end of the first media path and intersecting the first media path at a second intersection adjacent the entrance of the first media path, the first and second media paths forming a recycle loop, the pick assembly operable to feed at least a first media sheet and a second media sheet into the first media path at a predetermined inter-page gap G for image processing, a media retractor and recycler system comprising: a first drive mechanism; a recycler roll assembly positioned adjacent the Y-shaped first intersection on a portion of the second media path that forms one arm of the Y-shaped first intersection and is operatively connected with the first drive mechanism, the recycler roll assembly having a pair of opposed rolls forming a nip therebetween for receiving one of the first media sheet and then the second media sheet, the recycler roll assembly operable by the first drive mechanism to drive each of the first and then second media sheets along the second media path portion of the recycle loop toward the first media path portion of the recycle loop; a reversible drive mechanism; an exit roll assembly for concurrently supporting the first and second media sheets and positioned at the base of the Y-shaped first intersection and comprising an idler roll and a drive roll forming a nip therebetween, the drive roll operatively connected with the reversible drive mechanism and rotatable in an exit direction when the reversible drive is rotating in first direction and rotatable in a retraction direction when the reversible drive rotates in a second direction opposite the first direction, the first and second media sheets when moving in the exit direction move toward the output area and when moving in the retraction direction move into the second media path; a nip positioner for adjusting a height of the nip of the exit roll assembly within a range between a closed position and an open position to allow for the first media sheet and the second media sheet to be simultaneously received in and movable through the exit roll assembly nip in opposite directions; a diverter structure located immediately adjacent the first intersection, the diverter structure diverting one of the first media sheet and second media sheet into the second media path when one of the first and second media sheets are fed from the exit roll assembly in a retraction direction; the recycler roll assembly nip applying when one of the first and second media sheets are in the recycler roll assembly nip a retraction force that is equal or greater than 1.5 times the sheet to sheet frictional force between the first and second media sheets when the first and second media sheets are in an overlapping arrangement within the exit roll assembly allowing one of the first and second media sheets to be fed in the retraction direction and allowing the other of the first and second media sheets to be fed in the exit direction from the exit roll assembly; and the idler roll of the exit roll assembly positioned so that it contacts the one of the first and second media sheet that is being retracted by recycler roll mechanism in the retraction direction R while drive roll of the exit roll assembly is positioned to contact and feed the other of the first and second media sheets in the exit direction.

In one configuration, the recycle loop has a length that is less than 2Lmax and greater than Lmax where Lmax is the predetermined maximum length of the media input area of the imaging device plus two times the inter-page gap plus distance between the gate and the exit roll assembly. In a further configuration, the recycle loop has a length that is approximately equal to Lmax plus two times the inter-page gap G plus a distance between the diverter structure and the exit roll assembly. In another configuration the idler roll of the exit roll assembly is positioned substantially vertically above the drive roll of the exit roll assembly.

Also provided is a method for image processing a pair of media sheets supported concurrently within a retractor and recycler system in an imaging device comprising:

picking a first media sheet of the pair of media sheets for the duplex image processing;

driving the first media sheet along a first path extending from a pick assembly to an exit roll assembly of the retractor and recycler system passing through a first feed roll assembly, a processing zone of the imaging device, a second feed roll assembly and a diverter structure device for scanning a first side of the first media sheet, image processing a first side of the first media sheet while in the processing zone;

concurrently performing:

picking a second media sheet of the pair of media sheets and driving the second media sheet into the first media path and the processing zone at a predetermined inter-page gap from the first media sheet;

image processing a first side of the second media sheet along the first path through the processing zone;

driving the first media sheet with the second feed roll assembly past the diverter structure to the exit roll assembly;

driving the first media sheet with the exit roll assembly in an exit direction with a portion of the first media sheet being held in a nip of the exit roll assembly;

using the diverter structure to divert first media sheet into a second media path extending from the exit assembly in a retraction direction and coupled to the first media path intermediate the pick mechanism and the first feed roll assembly forming a recycle loop; and reversing the direction of the exit roll assembly and driving the first media sheet into the second media path and to a recycler roll assembly;

retracting the first media sheet along the second media path in a retraction direction with the recycler roll assembly and feeding the first media sheet back into the first media path;

decreasing a nip pressure in the exit roll nip and driving the second media sheet into exit roll assembly in an exit direction while the first media sheet is being retracted;

increasing nip pressure in the exit roll assembly nip after the first media sheet exits the exit roll assembly nip and retaining the second media sheet within the exit roll assembly nip;

driving the first media sheet into the processing zone and image processing a second side;

reversing the exit roll assembly and driving the second media sheet along the second media path to the recycler roll assembly;

driving the second media sheet along the first media path through the processing zone and image processing a second side of the second media sheet;

driving the first sheet to the exit roll mechanism; and determining if collation is needed and if so driving the first media sheet then second media sheet into the second media path and first media path back to and through exit roll assembly to an output area, and if not driving the first media sheet and then the second media sheet through exit roll assembly into the output area.

BRIEF DESCRIPTION OF THE DRAWINGS

The above-mentioned and other features and advantages of the present disclosure, and the manner of attaining them, will become more apparent and will be better understood by reference to the following description of embodiments of the disclosure taken in conjunction with the accompanying drawings, wherein.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure provides a retractor and recycler system to concurrently support a pair of media sheets for duplex scanning or duplex printing. The retractor and recycler of the present disclosure is operatively coupled with an imaging processor, such as a scanner as found in an All-in-One (AIO) device or a print engine as found in a printer or an AIO.

Figure 3:
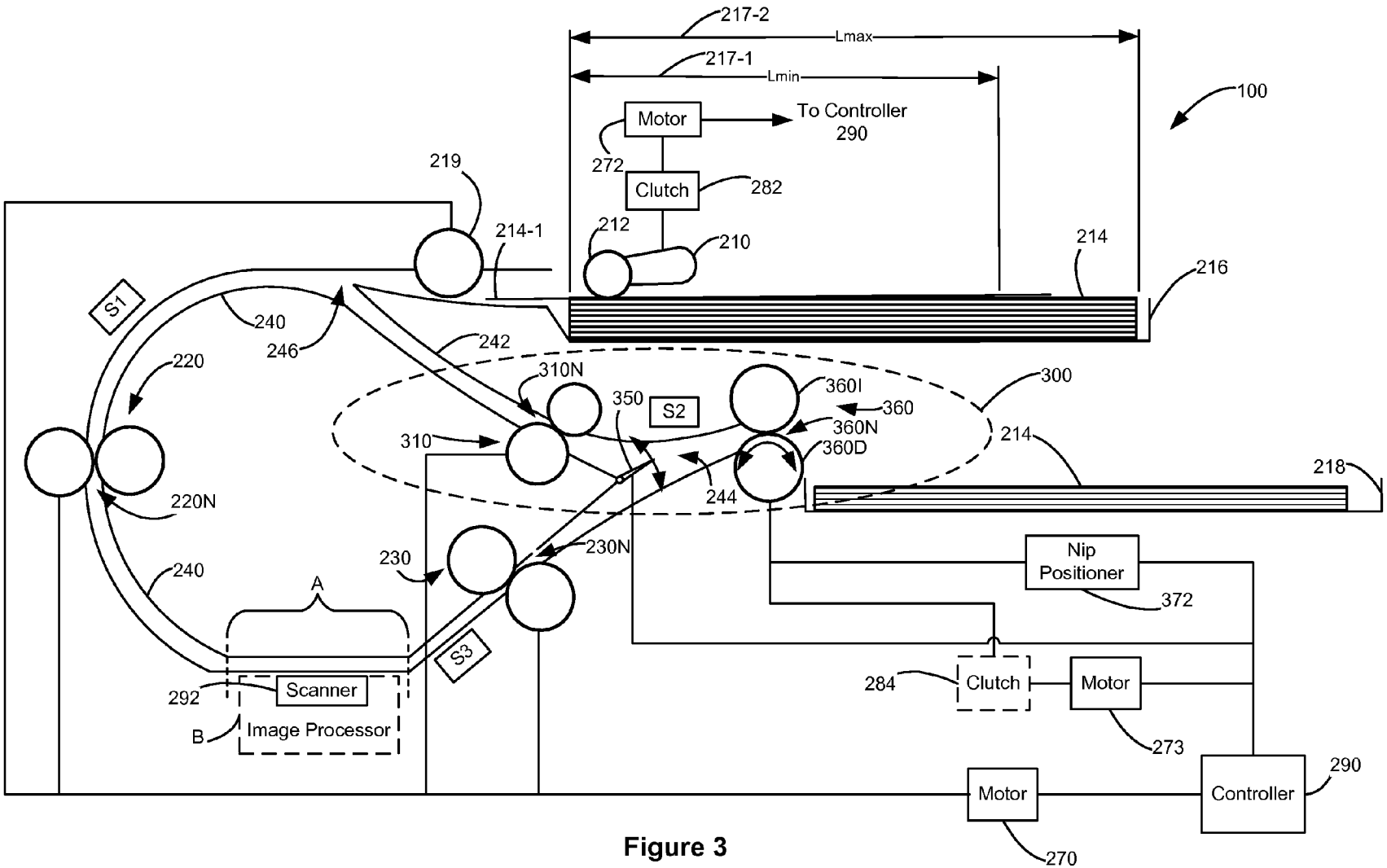
FIG. 3 depicts a layout of a media retractor and recycler in an imaging device, in accordance with an embodiment of the present disclosure.

FIGS. 3 to 9 depict a media retractor and recycler system 300 (hereinafter referred to as "retractor 300" and as indicated by the dashed ellipse in FIG. 3) that is operatively coupled with an image processor B, such as a scanner 292 as illustrated or a print engine as part of a recycler loop. In one form retractor 300 comprises an exit roll assembly and a recycler roll assembly positioned on a media path within an imaging device, such as a printer or scanner.

As used herein the term "image processor" is meant to include scanners that read information from a media sheet when a scanner is used in the recycle loop and to include print engines which apply information to a media sheet when a print engine is used in the recycler loop. Either a scanner or a printer may be used with the retractor and recycler system 300. Further both a scanner and a print engine may be used within a single recycle loop. Similarly the term "image processing" is meant to include both the scanning of information from a media sheet and the printing of information on a media sheet when a scanner or print engine are present. Elements having the same or similar reference numerals have the same or similar function as those previously described and their description will not be repeated.

Figure 1:
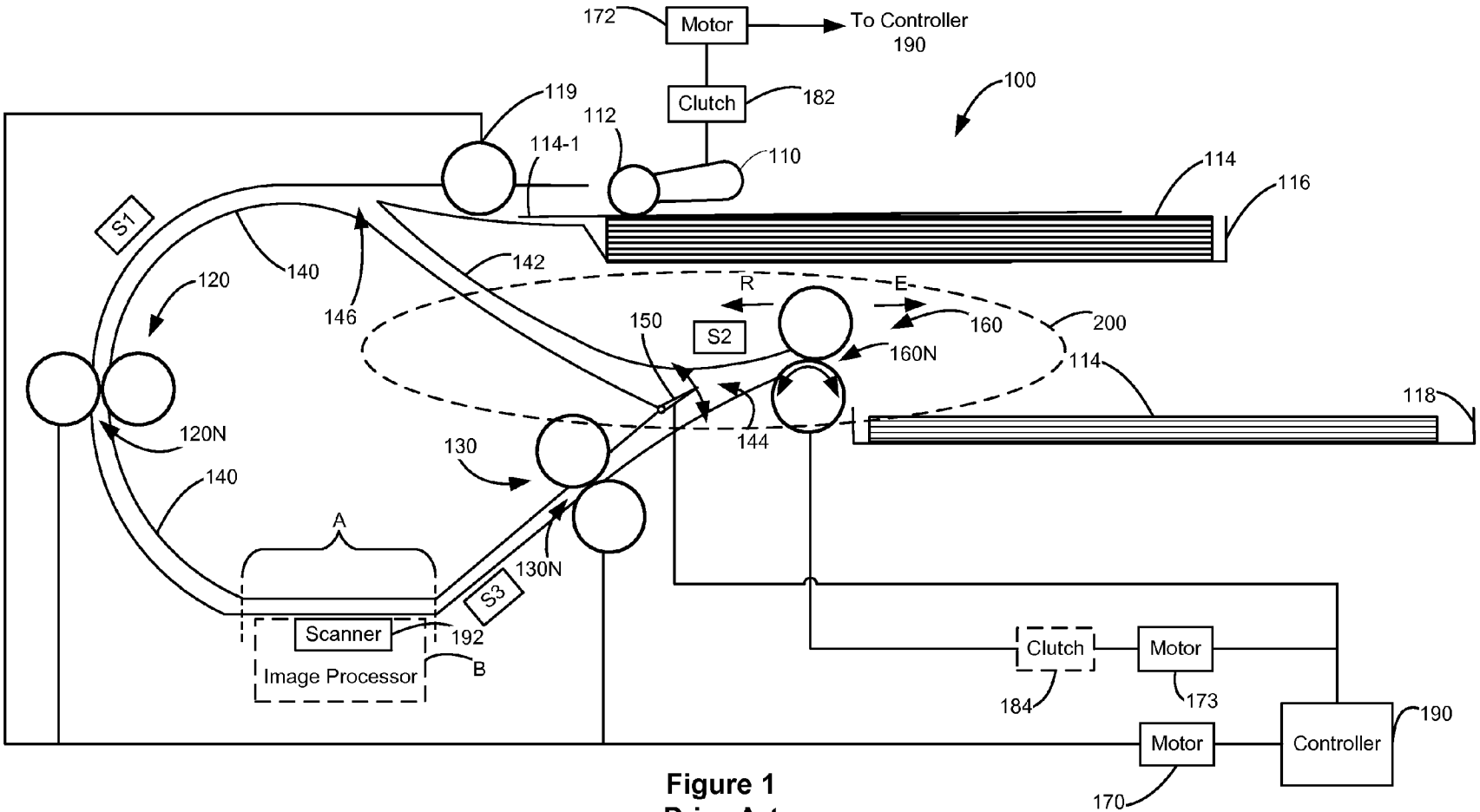
Figure 1 Prior Art
FIG. 1 depicts a layout of a prior art media retractor and recycler illustrated in a imaging device.
Figure 2:
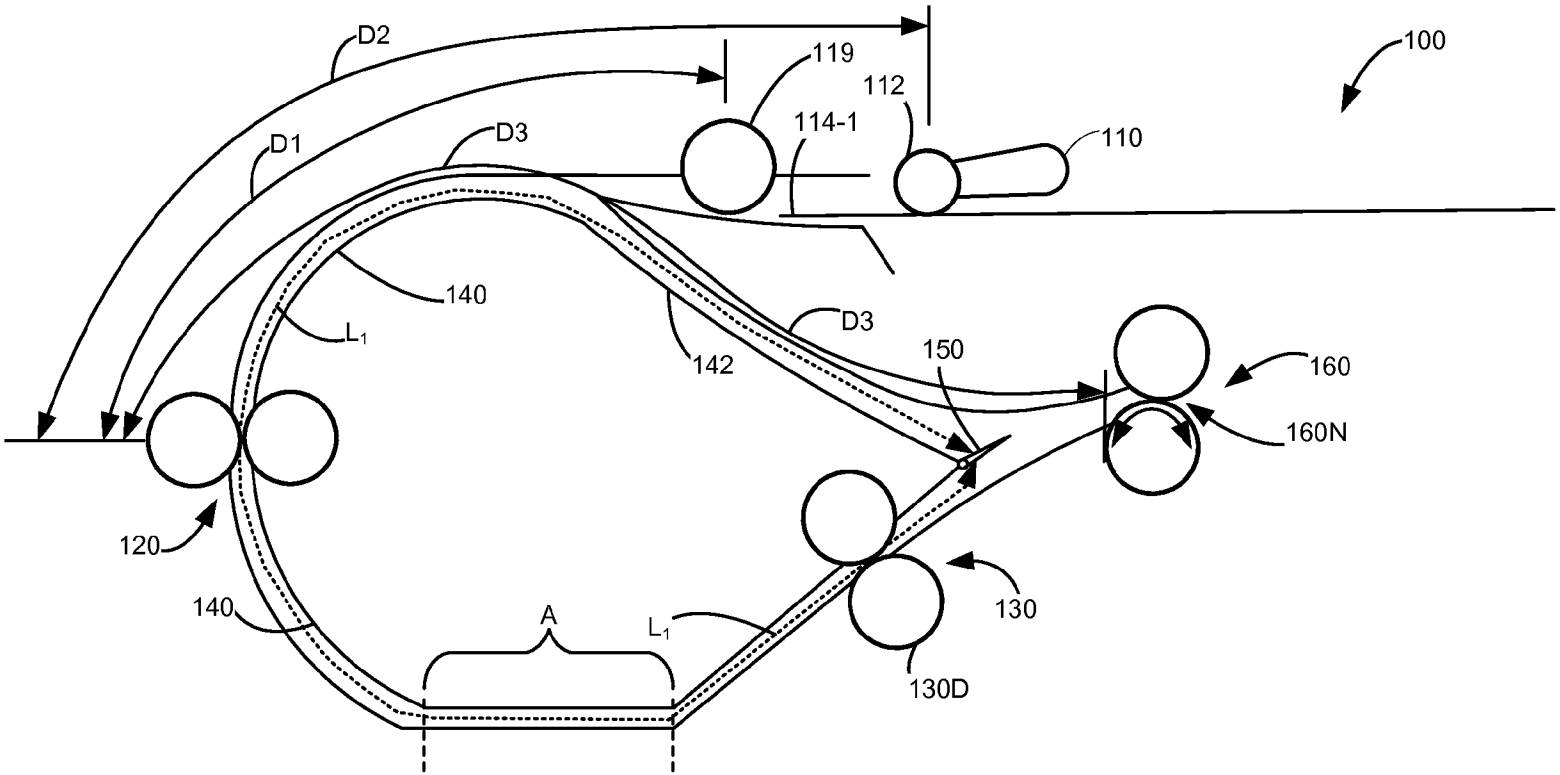
Figure 2 Prior Art
FIG. 2 illustrates various media feed paths of the prior art media retractor and recycler illustrated in FIG. 1 with some of the components removed for clarity.

FIG. 3 is schematically similar to FIG. 1. A first media path 240 and a second media path 242 form a recycle loop $L_2$ which is illustrated as beginning and ending at diverter structure 350 (see FIG. 4). First media path 240 has an entrance adjacent a pick assembly 210 and an exit at an exit roll assembly 360 and has positioned therealong a first feed roll assembly 220, a processing area A having an image processor B, and a second feed roll assembly 230, all of which function in a substantially similar manner to their counterparts shown in FIG. 1. Second media path 242 intersects first media path 240 at a first intersection 244 adjacent exit roll assembly 360 and at a second intersection 246 adjacent the entrance of first media path 240. First and second media paths 240, 242 intersect at 244 in a generally Y-shaped path configuration adjacent an exit roll assembly 360. Exit roll assembly 360 is positioned at the base of the Y while first and second media paths 240, 242 form respective arms of the Y-shaped path with recycler roll assembly 310 positioned adjacent intersection 244 on one arm of the Y (the upper arm as viewed in FIG. 3). Intersection 246 is also generally Y-shaped with the base of the Y extending toward first feed roll assembly 220 with first and second media paths 240, 242 forming respective arms of the Y. In retractor 300, recycler roll assembly 310 has been positioned along second media path 242 downstream of but adjacent to a diverter structure, such as gate 350. Recycler roll assembly 310 is positioned from exit roll assembly 360 at a distance that is less than the inter-page gap G. Sensors S1-S3 function as previously described with respect to FIG. 1.

First feed roll assembly 220 comprises a pair of rolls forming nip 220N as is upstream of processing area A along first media path 240 and is functionally similar to first feed roll assembly 120. Second feed roll assembly 230 comprises a pair of rolls forming nip 230N and is downstream of processing area A along first media path 240. The materials forming the pairs of rolls include rubber as well as those having lower coefficient of friction. Again either or both of the rolls in each feed roll assembly 220, 230 may be driven by a motor such as motor 270. Feed roll assembly 230 is functionally similar to feed roll assembly 130 however its position has been moved further upstream in first media path 240 closer to processing area A to lengthen its distance to a diverter structure such as gate 350.

Recycler roll assembly 310 comprises a pair of rolls forming nip 310N therebetween. Either or both of the rolls in recycler roll assembly 310 may be driven by a motor such as motor 270. For reasons set forth herein, it has been empirically determined that the frictional force in nip 310N applied by the pair of rolls in recycler roll assembly 310 should be at least 1.5 times the frictional forces occurring when two media sheets are in an overlapping arrangement within exit roll assembly 360. The frictional force created by the overlapping of the media sheets is referred to as sheet to sheet friction, (such as when first and second media sheets 114-1, 114-2 are in overlapping arrangement within nip 360N). Having nip force in nip 310N be 1.5 times the sheet to sheet friction ensures reliable retraction of a media sheet by recycler roll assembly 310 into second media path 242. Materials having suitable coefficients of friction for use in the pair of rolls in recycler 310 include rubber which has been found to perform well over a variety of media types and surfaces generally used in imaging device 100.

Exit roll assembly 360 is located downstream of feed roll assembly 230 and upstream of recycler roll assembly 310. Exit roll assembly 360 comprises a drive roll 360D and an idler roll 360I that form nip 360N therebetween. Exit roll assembly 360 is bi-directional or reversible so that media sheets may be driven in an exit direction E (toward output area 218) or be retracted and driven in a retraction direction R into second media path 242 for recycling. As illustrated, idler roll 360I is positioned generally above drive roll 360D so that drive roll 360D will contact a bottom surface of a media sheet in nip 360N while idler roll 360I will contact an upper or top surface of a media sheet in nip 360N as viewed in FIG. 3. Alternatively this arrangement may be described as one where when two media sheets overlap within nip 360N, idler roll 360I is to be positioned so that it contacts the media sheet that is being retracted by recycler roll mechanism 310 in the retraction direction R while drive roll 360 contacts the media that is being fed into exit roll assembly 360 in the exit direction E. This orientation of drive roll 360D and idler roll 360I provides innovative benefits during operation of retractor 300 as further described herein.

Drive roll 360D is operatively connected to motor 273 or as described below may be operatively connected to motor 273 via optional clutch 284. With either configuration, drive roll 360D may be operated independently of first and second feed roll assemblies 220, 230 and recycler roll assembly 310. The frictional force applied to a media sheet by drive roll 360D should be greater than the sheet to sheet friction occurring when two media sheets are simultaneously within nip 360N. Materials for drive roll 360D include rubber while materials for idler roll 360I include any material having a lower coefficient of friction than drive roll 360D, or a similar material may be used in combination with lowering the force of nip 360N such as by adjusting the height of nip 360N using a nip adjustment mechanism.

A nip positioner 372 is operatively connected to exit roll assembly 360 and controller 290 and may be used to vary the height of nip 360N to vary nip pressure applied to media sheets in exit roll assembly as explained herein. Retractor 300 may optionally further include a diverter structure such as gate 350 for diverting a media sheet into second media path 242 and a feed roll assembly 230 located downstream of processing zone A. Diverter structure 370 may also be created by the design and location of intersection 244 relative to exit roll assembly 360. For example when a media sheet is initially being fed in the retraction direction R by exit roll assembly 360, the retracted media sheet may be thought of as a cantilevered beam due that would allow the free end leading edge of the retracted media sheet to pass over the opening into first media path 240 at intersection 244. Placing intersection 244 in the region where the retracted media sheet is cantilevered would allow the retracted media to be diverted into second media path 242 without the use of a gate. Eventually as more of the media sheet is feed from the exit roll assembly 360 toward second media path 242 the weight of the media sheet would cause the media sheet to droop but this would occur after intersection 244 has been passed.

If gate 350 is provided as the diverter structure it may be operatively connected to controller 290 and is located upstream of recycler roll assembly 310 and downstream of feed roll assembly 230. Gate 350 may also be gravity operated to fall across first media path 240 and not be operatively connected to controller 290. With gravity operation of gate 350, a media sheet being fed toward exit roll assembly 360 will be driven by second feed roll assembly 230 with sufficient force to lift gate 350 allowing the driven media sheet to reach nip 360N of exit roll assembly 360.

For feed roll assemblies 220, 230 and recycler roll assembly 310 either or both rolls may be operatively connected to motor 270. Motor 273 is illustrated as being operatively connected to exit roll assembly 360 while motor 272 is illustrated as being operatively connect to pick mechanism 210 via clutch 282. Further motors 272 and 273 may be replaced by a single motor and optional clutch 284 may be operatively connected between exit roll assembly 360 and motor 273. The coordination of media movement, motors, drive rolls in the various assemblies, clutches, etc. is accomplished by controller 290.

Figure 5:
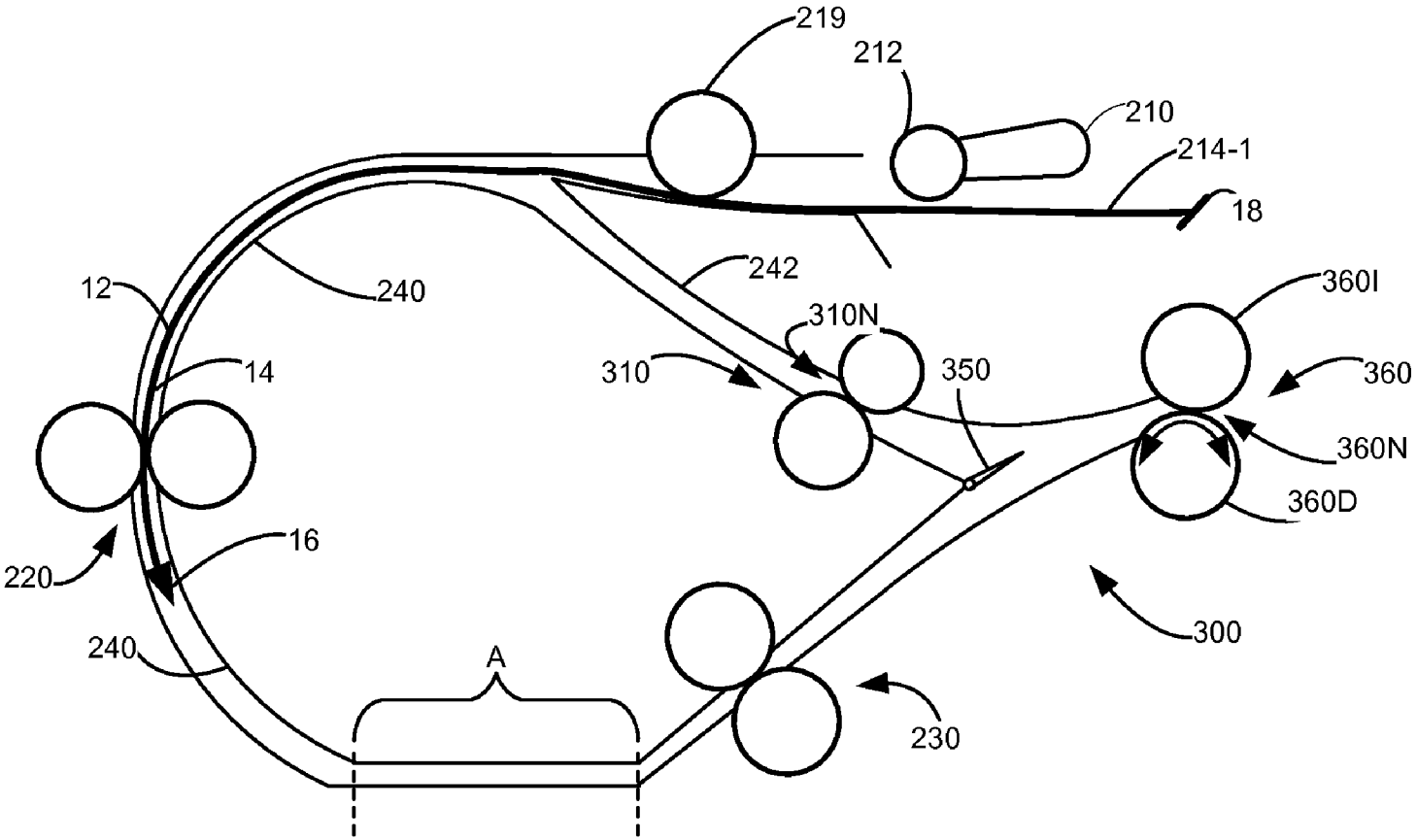
FIG. 5 depicts the layout of the media retractor and recycler of FIG. 3 when a first media sheet is fed into and driven through the device.
Figure 6:
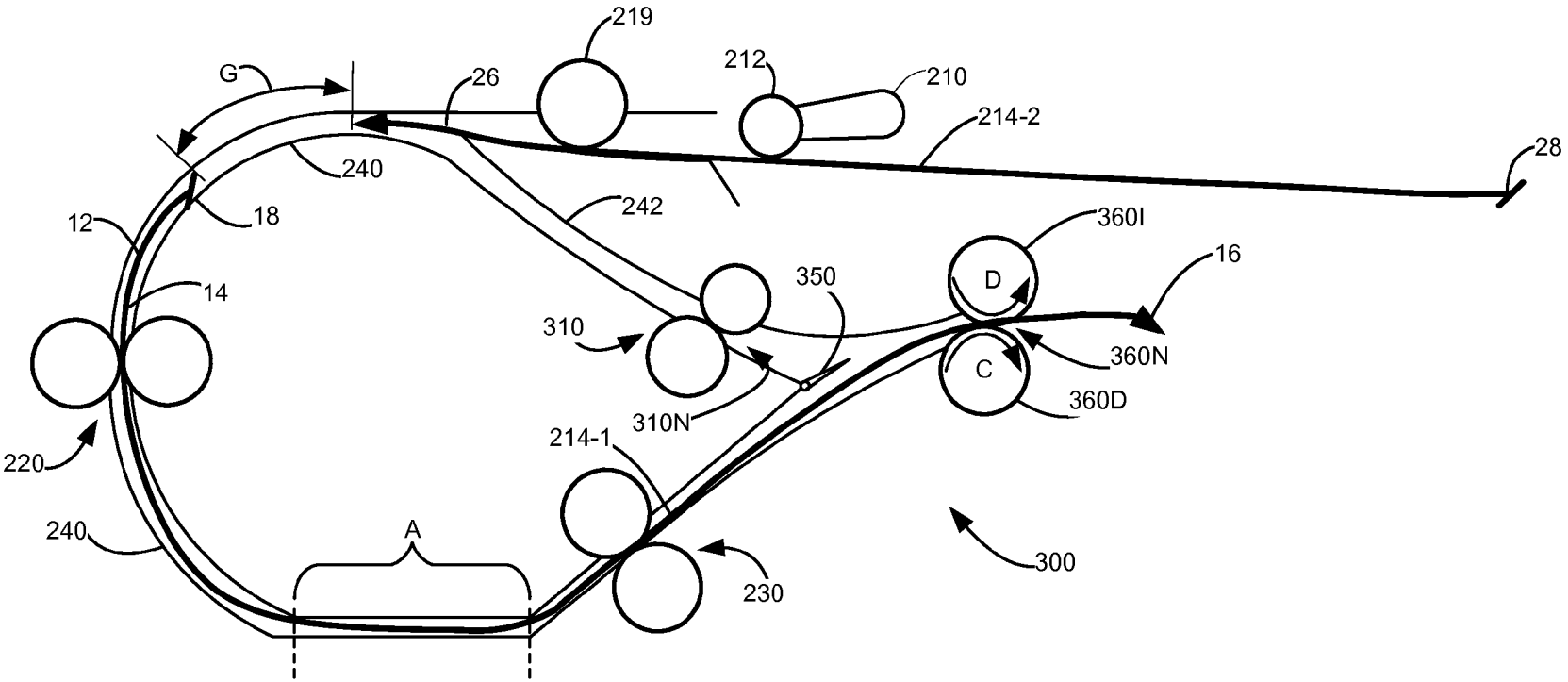
FIGS. 6-9 depict the layout of the retractor and recycler system of FIG. 3 when a second media sheet is fed into and driven through the retractor and recycler system, the second media sheet being separated at a predetermined inter-page gap from the first media sheet.

Pick assembly 210 picks a first media sheet 214-1 of a pair of media sheets (as depicted in FIG. 5) from input area 216 having a minimum length Lmin 217-1 and a maximum length Lmax 217-2 corresponding to the predetermined minimum and maximum lengths of the media image area of the imaging device 100 (See FIG. 3). Lmax 217-1 may have a predetermined length of 297 mm which allows for use of A4 media while Lmin 217-2 may have a determined length of 148 mm which allows for use of A6 media. Pick assembly 210 then picks a second media sheet 214-2 of the pair of media sheets (as depicted in FIG. 6) from input area 216. Along first media path 140, second media sheet 214-2 is separated at a predetermined inter-page gap, G, from first media sheet 214-1. It will be evident that pick assembly 210 may be coupled with an input media stack 214 for picking first and second media sheets 214-1, 214-2 from input media stack 214.

Pick roll 212 picks second media sheet 214-2 after a predetermined time interval such that second media sheet 214-2 is separated from first media sheet 214-1 at the predetermined inter-page gap G along first media path 240. Accordingly, the predetermined time interval corresponds to the predetermined inter-page gap G between first media sheet 214-1 and second media sheet 214-2. Again drive roll 219 positioned in proximity to pick roll 212 feeds first media sheet 214-1 and second media sheet 214-2 into first media path 240 toward a feed roll assembly 220.

Figure 7:
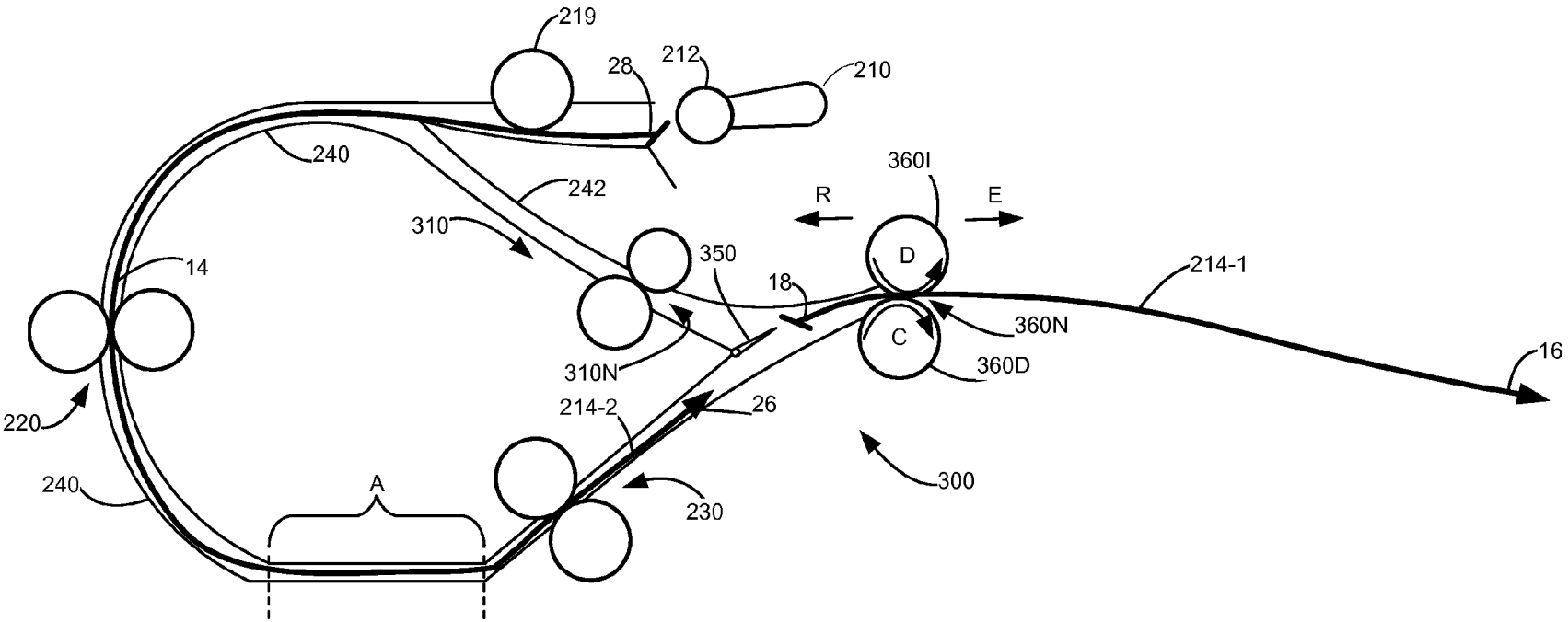

Exit roll assembly 360 drives first media sheet 214-1 and second media sheet 214-2 out from retractor 300 in a predetermined order into output area 218. First feed roll assembly 220 drives first media sheet 214-1 and second media sheet 214-2 along first media path 240 (a path for simplex scanning) extending from pick assembly 210 to exit assembly 360 through processing zone A past imaging processor B for scanning or printing a first side 12 and a second side 14 of first media sheet 214-1 and a first side 22 and a second side 24 of second media sheet 214-2 (as depicted in FIGS. 5-7). Feed roll assembly 230 drives media sheets 214-1, 214-2 past the diverter structure, e.g., gate 350, and into exit roll assembly 360. It will be realized by one of skill in the art that if a print engine is image processor B, it would be typically located above the media sheets as they pass through processing zone A for face up output collation or located below the media sheets for face down output collation. Also should a scanner be used as image processor B it may be placed either above or below the media sheets depending upon how the media is loaded in input area 216. As illustrated the preprinted media to be scanned would be loaded face up with the scanner being below the media.

First media sheet 214-1 is shown to have a first edge 16 and a second edge 18. Similarly, second media sheet 214-2 is shown to have a first edge 26 and a second edge 28. As shown in FIG. 5 media sheet 214-1, first edge 16 is the leading edge and second edge 18 is the trailing edge given the forward feed direction of media sheet 214-1. When a media sheet is retracted and recycled, the leading edge becomes the trailing edge and the trailing edge becomes the leading edge as the media sheet is fed through the recycling process along first and second media paths 240, 242.

Figure 8:
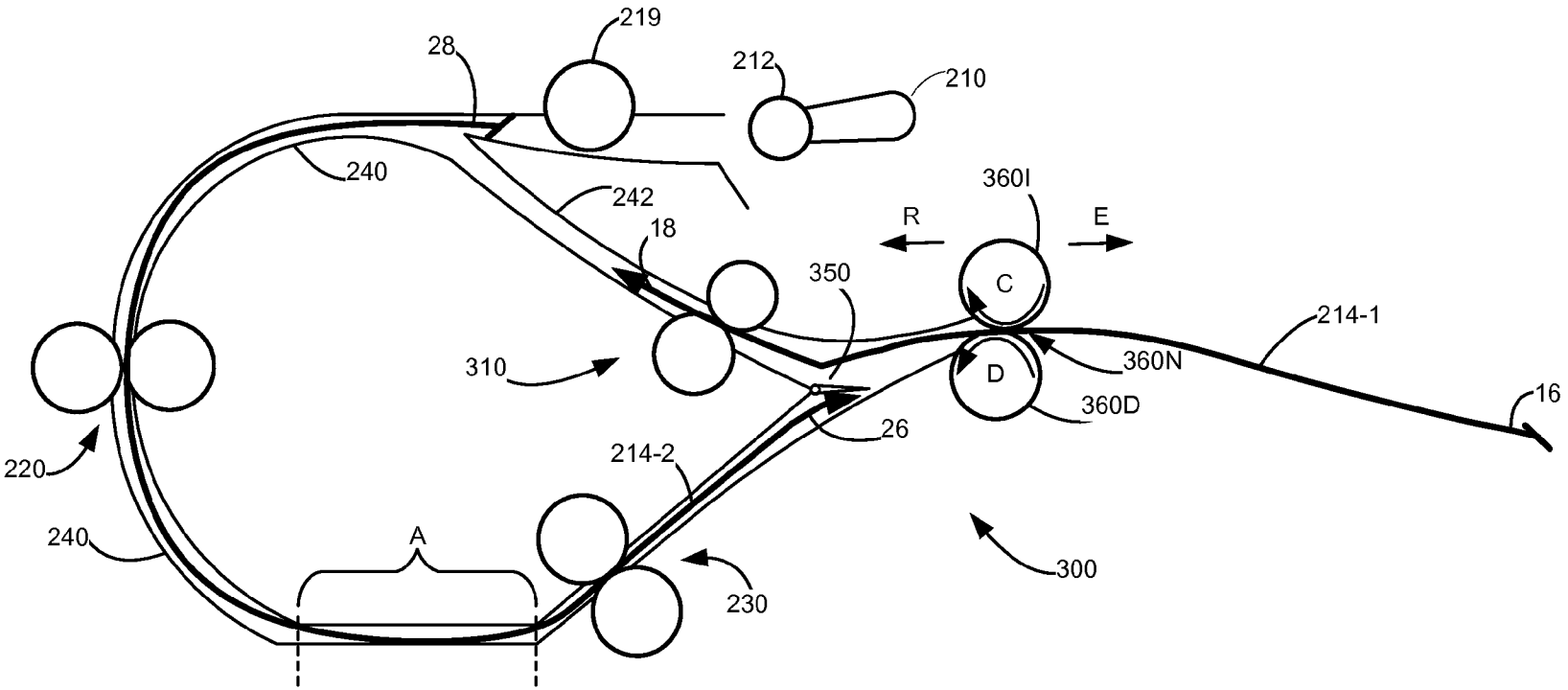
Figure 9:
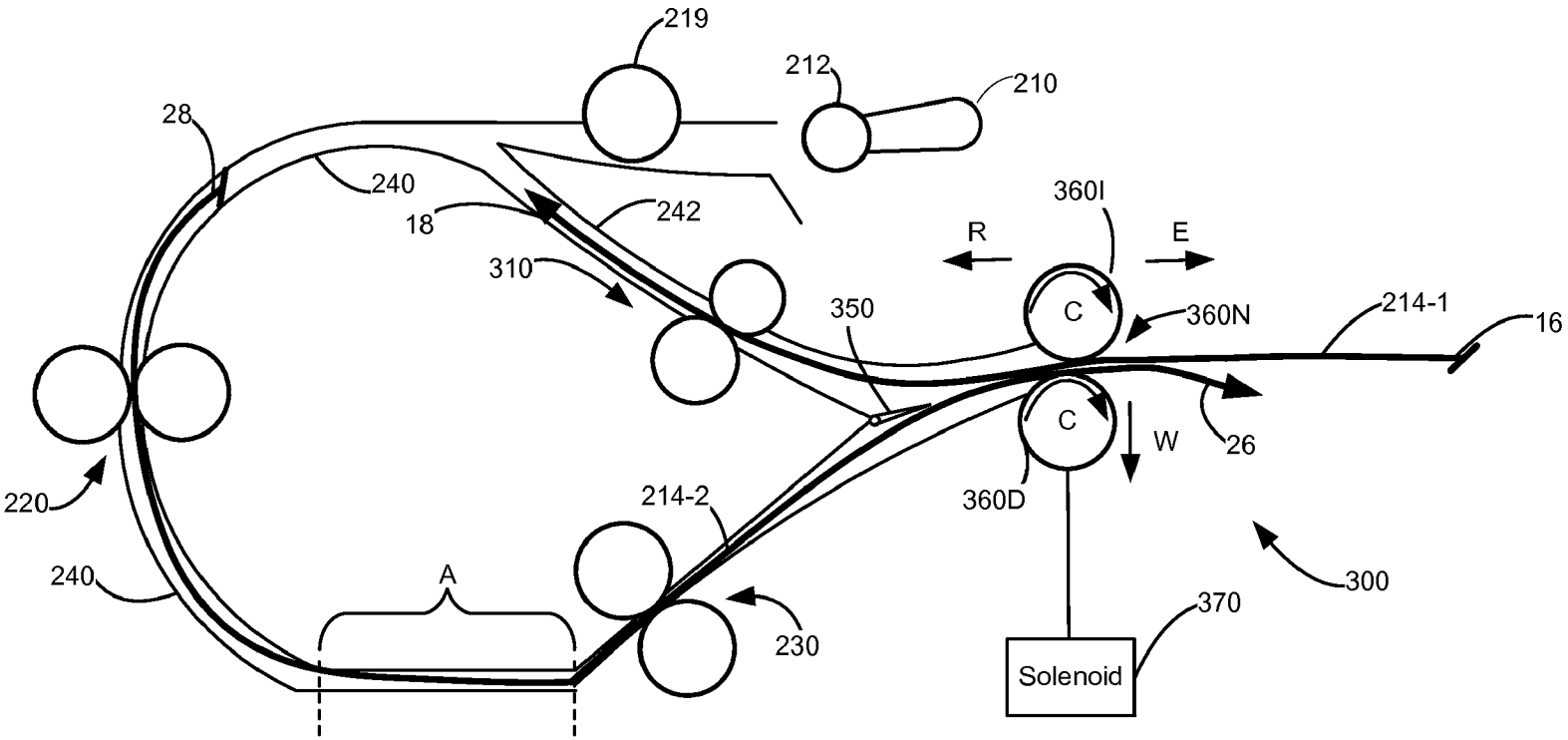

During duplex scanning or printing, recycler roll assembly 310 of retractor 300 consecutively drives first media sheet 214-1 and second media sheet 214-2 along second media path 242 (return path) extending from exit roll assembly 360 towards to a junction point 246 intermediate the start of first media path 240 and feed roll assembly 220. Specifically, in one form second media path 242 extends from exit roll assembly 360 in a direction R opposite to an exit direction E (as depicted in FIGS. 7-9). Second feed path 242 is coupled with first media path 240 to form a loop, as termed a recycle loop which defines a feed path of retractor 300.

In addition, retractor 300 includes diverter structure, such as gate 350, at a junction between first media path 240 and second media path 242 positioned between exit roll assembly 360, feed roll assembly 230 and recycler roll assembly 310. Diverter gate 350 diverts the retracted first media sheet 214-1 and retracted second media sheet 214-2 along the second path 242 into the recycler loop. Except as described hereinbelow, clutches 282, 284, motors 270, 272 and 273 and controller 290 operate as previously described.

Figure 4:
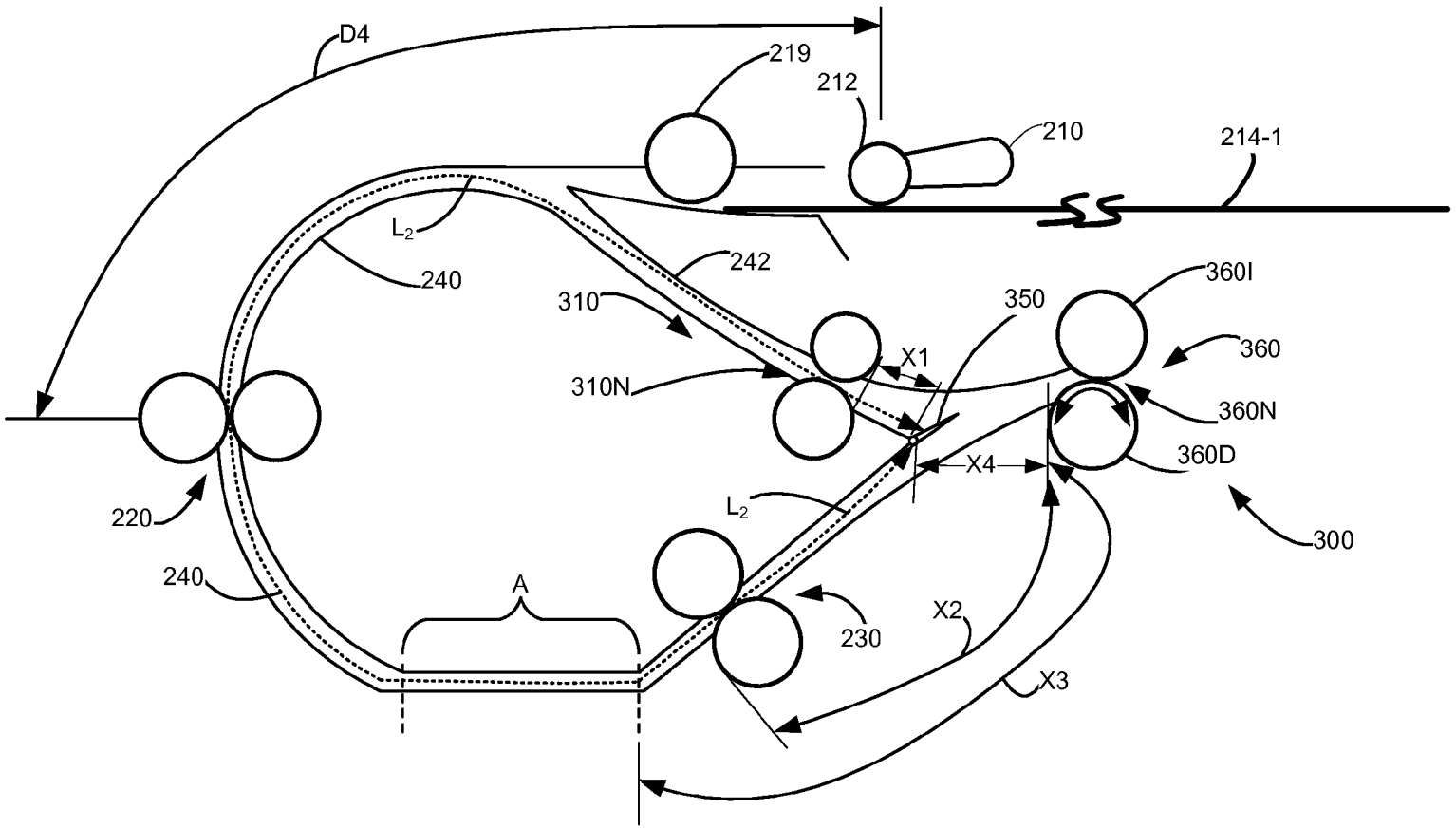
FIG. 4 illustrates various media feed paths of the media retractor and recycler illustrated in FIG. 3 with some of the components removed for clarity.

The term "predetermined inter-page gap G", is the gap two successive media sheets when traveling along first media paths 140, 240 or second media paths 142, 242 also may correspond to a distance between exit roll assembly 360 and diverter structure, such as gate 350, and in some embodiments may be about 3 cm. Further, in some embodiments, the length of the recycle loop $L_2$ beginning at diverter structure 350 through second media path 242 and first media path 240 back to diverter structure 350 is about 38 cm (as depicted in FIG. 4); the distance between the diverter structure, e.g. gate 350, and exit roll assembly 360 is about 2 cm; and the distance from pick roll 212 to the feed roll assembly 220 has increased to about 18 cm (as depicted by D4 in FIG. 4), which is longer than an A6 media sheet. In order to support shorter media sheets, an additional feed roll assembly between drive roll 219 and first free roll assembly 220 may be provided. Such additional feed roll assembly may also be driven by motor 270. Additionally, the distance between recycler roll assembly 310 and first feed roll assembly 220 is about 16.3 cm, which would correspond to the minimum media sheet length that is supported in the illustrated duplex path. Also, the distance between second feed roll assembly 230 and exit roll assembly 360 is about 9 cm, as depicted by X2 in FIG. 4.

The distance X1 between the diverter structure, e.g., gate 350, and nip 310N should be less than the inter-page gap G. Such a distance should be minimized, as the inter-page gap G is an important factor for determining the throughput. The distance between the diverter structure, e.g. gate 350, and exit roll assembly 360 should also be minimized as each media sheet of the first and the second media sheets 214-1, 214-2 has to pass the diverter structure, e.g., gate 350, before each media sheet may change direction and follow second media path 242. However as one of skill in the art would recognize, the distance between the diverter structure, e.g. gate 350, and exit roll assembly 360 has to be adequate for exit roll assembly 360 to stop and maintain control of a media sheet. During recycling of media sheets, the leading edge (second edge 18) of first media sheet 214-1 in second media path 242 has to be engaged by recycler roll assembly 310 before the bi-directional exit rolls of exit roll assembly 360 may stop, change directions and accept second media sheet 214-2 from the first media path 240 and using drive roll 360D feeds it forward toward output area 218. The distance X2 between second feed roll assembly 230 and exit roll assembly 360 may be kept as large as practicable without increasing or only slightly increasing the overall length $L_2$ of recycle path. This should be accomplished by moving second feed roll assembly 230 further upstream toward processing zone A rather than moving exit roll assembly further away from gate 350. Moving exit roll assembly 360 away from gate 350 only increases size and cost of imaging device 100 without improving media throughput. The maximum value for X2 would be the equal to a predetermined minimum length, Lmin, of the media input area 216 of the imaging device 100 determining the shortest media useable in the imaging device 100, for example, A6 media. Increasing distance X2 allows the trailing edge of the media sheet that has just been image processed to be to be released earlier from nip 230N than if second feed roll assembly 230 were closer to exit roll assembly 360. This in turns allows controller 290 to speed up drive roll 360D which in turn speeds up second media sheet 214-2 reducing the inter-page gap G with the media sheet ahead of it. This is advantageous when, for example, a media sheet traversing processing zone A has been slowed and the subsequent speed up allows it to catch up with the media sheet ahead of it thus maintaining or even slightly increasing overall throughput.

As previously described distance X2 is the distance between feed roll assembly 230 and exit roll assembly 360 and X2<Lmin, where Lmin is the predetermined minimum length of the media input area which determines the shortest media supported. Optimally, X2 would be at least two times the inter-page gap G, i.e., X2>2G, as this improves throughput for media having a length that is less than Lmax. The location of second feed roll assembly 230 downstream of first feed roll assembly 220 is less than the Lmin to ensure that each of media sheets 214-1 and 214-2 will have driving force to reach exit roll assembly 360.

The length L2 of the recycle loop should be in the range of: Lmax<L2<2Lmax, where Lmax is the predetermined length of the input area 216 which determines the longest supported media useable in the imaging device 100. An optimum length for L2 would be approximately equal to the sum of:

$L2 \approx Lmax$+the inter-page gap $G$+distance $X4$ between diverter structure, e.g. gate 350, and exit roll assembly 360;

where in some embodiments X4 is approximately equal to inter-page gap G and assuming that trailing edge of the media sheet (such as second edges 18, 28 of media sheets 214-1, 214-2) stops about half way between gate 350 and exit roll assembly 360 prior to a change in direction. For retractor 300 to support A4 media for duplex scanning or duplex printing for example length L2 would be 29.7 cm+(2×3 cm)+2 cm or 37.7 cm or approximately 38 cm. In the case where the speed of one of first media sheet 214-1 and second media sheet 214-2 (moving with the same speed) is increased in the first media path 240 this briefly increases inter-page gap G in first media path 240 but leads to a decreased inter-page gap G in the second media path 242 resulting in an overall reduction in the entire recycle loop length L2. Accordingly, the entire recycle loop dimensions may be reduced slightly to about 36 cm, a savings of about 2 cm. Further, horizontal and vertical dimensions of the recycle loop may be about 15 cm by about 7.8 cm, respectively. Accordingly, overall dimensions of the retractor 300 and recycle loop have increased only slightly in comparison to the prior art retractor and recycle loop shown in FIG. 1 while allowing for concurrent support of two media sheets. Further, recycler roll assembly 310 may be independently driven apart from first and second feed roll assemblies or alternatively the speed of drive roll 360D may be increased. Either would allow the retraction speed to be increased to reduce the inter-page gap that occurs when the recycle loop is not an optimum length.

Based on the foregoing, a minimum value for inter-page gap G between first media sheet 214-1 and second media sheet 214-2 may be achieved. Further, feed roll assembly 230 is moved away from exit roll assembly 360 in order to decrease the inter-page gap requirement in second media path 242. The minimum value for inter-page gap G around exit roll assembly 360 may also be determined by the time taken by drive roll 360D of exit roll assembly 360 to stop, reverse direction, and drive first media sheet 214-1 towards recycler roll assembly 310; stop again, and change direction to receive second media sheet 214-2 and drive it in exit direction E.

As directed by controller 290, nip positioner 372, such as a solenoid, coupled to exit roll assembly 360 may open nip 360N as second media sheet 214-2 enters nip 360N to avoid a paper jam at exit roll assembly 360. Further when both media sheets 214-1, 214-2 are in nip 360N, nip positioner 372 may be used to then slightly but not completely reduce the height of nip 360N which would provide a lower nip force applied to both media sheets than if nip 360 were in a fully closed positioned that may be used when a single media sheet is present. As illustrated, nip positioner 370 when actuated by controller 290 lowers drive roll 360D in direction W as shown in FIG. 9 to increase nip height. Of course, nip positioner 370 can be used to move idler roll 360I instead or move both idler roll 360I and drive roll 360D.

For duplex printing or scanning, first media sheet 214-1 and second media sheet 214-2 are then moved along the recycle path comprised of first media path 240 and second media path 242 for a predetermined number of times, and more specifically, three times for duplex scanning to achieve proper collation and twice for duplex printing. First media sheet 214-1 and second media sheet 214-2 are moved along first media path 240 for a first time for scanning or printing of first side 12 of first media sheet 214-1 and first side 22 of second media sheet 214-2. First media sheet 214-1 and second media sheet 214-2 are recycled by retractor 300 and are moved along the recycle path for a second time for scanning of second side 14 of first media sheet 214-1 and second side 24 of second media sheet 214-2. First media sheet 214-1 and second media sheet 214-2 are then moved along first media path 240 for a third time for driving first media sheet 214-1 and second media sheet 214-2 out from exit roll assembly 360 in the predetermined order. The predetermined order of first media sheet 214-1 and second media sheet 214-2 may correspond to collation of these two sheets to have first side 12 and first side 22 oriented in a face-down direction when collected in output area 218.

Controller 290 rotates drive roll 360D in a first direction C (such as a clockwise direction) and idler roll 360I rotates in a second direction D (such as an anticlockwise direction) opposite to the first direction C (as depicted in FIGS. 6 and 7) which direct first media sheet 214-1 moving along the first path 240 toward output area 218 as shown in FIG. 7. Upon reversing drive and idler rolls 360D, 360I retract first media sheet 214-1 and gate 350 is positioned to direct first media sheet 214-1 along second media path 242 when drive roll 360D is driven to rotate in the second direction D and idler roll 360I follows drive roll 360D and first media sheet 214 tin the first direction C (as depicted in FIG. 8). As first media sheet 214-1 is passing through recycler roll assembly 310 along second media path 242 and being retracted from exit roll assembly 360 (as depicted in FIG. 9), drive roll 360D is again driven to rotate in the first direction C in order to receive second media sheet 214-2 while idler roll 360I continues to rotate in first direction C and follow first media sheet 214-1 as it is being retracted. Both first and second media sheets 214-1, 214-2 are within exit roll assembly 360 but moving in opposite directions. Drive roll 360D is moving second media sheet 214-2 toward exit area 218 while drive roll 310D is pulling first media sheet 214-1 into and through second media path 242. This is possible because the rotational force found in nip 310N for recycler roll assembly 310 is greater than that of exit roll assembly 360 and overcomes the sheet-to-sheet friction between media sheets 214-1, 214-2. Use of nip positioner 370 to increase nip 360N height decreases the rotational force on the media within the nip 360N. Nip 360N would be adjustable within a range between a minimum nip height, referred to as a closed position that may be used for a single media sheet up to a maximum nip height, referred to as an open position, where little or no rotational force would be applied when two media sheets are in nip 360N. This adjustably allows the amount of rotation force to be varied depending on the number of media sheets entering or within nip 360N. Alternatively, idler roll 360I may be made of a lower friction material allowing media sheet 214-1 to more easily slip as it is retracted by recycler roll assembly 310. Idler roll 360I and first media sheet 214-1 may be viewed as skidding over the surface of media sheet 214-2. After first edge 26 (which is a leading edge) of second media sheet 214-2 passes into nip 360N, nip positioner 370 is de-actuated to close or reduce the height of nip 360N to its closed position so that second media sheet 214-2 can continue to be fed toward output area 118 until the second edge 28 which is the trailing edge is past the diverter structure, e.g., gate 350. At this point exit roll assembly 360 is stopped and its direction reversed to retraction direction R feeding second edge 28 into second media path 242 making second edge 28 the leading edge of second media sheet 214-2. Because of the timing of the movement of media sheets 214-1 and 214-2 with the recycle loop, if nip 360N is not reduced in height until first edge 16 (which is now a trailing edge) of first media sheet 214-1 exits nip 360N, no driving force would available to drive second media sheet 214-2 as it has exited feed roll assembly 230 and little or no driving force would be available from exit roll assembly 360 due to the increased height of the nip 360N. This would cause second media sheet 214-2 to stall in first media path 240.

Because of the routing of the media sheets 214-1, 214-2 in exit roll mechanism 360 both first and second media sheets 214-1, 214-2 are in nip 360N at the same time and moving in opposite directions with the top sheet (media sheet 214-1) being retracted out of exit roll assembly 360 while the bottom sheet (media sheet 214-2) moves in the opposite direction toward output area 218. The amount of overlap between two media sheets overlap outside of nip 360 in the exit direction E is approximately V2 of the length of the media sheets. As media sheet 214-1 is pulled in the retraction direction R, first edge 16 of media sheet 214-1 passes first edge 26 of media sheet 214-2 as it moves in exit direction E. Where this occurs is at a point where about ½ of each of media sheets 214-1, 214-2 are extending on the exit side of nip 360N.

As illustrated, idler roll 360I should be positioned above drive roll 360D so as to contact the top media sheet (first media sheet 214-1 as illustrated) in that idler roll 360I would not provide any significant opposite rotational force to the rotation force of recycler roll assembly 310 used to retract the top media sheet. If drive roll 360D were the top roll of these two rolls, then when leading edge of the following or subsequent media sheet (leading edge 26 of second media sheet 214-2), idler roll 360I would provide no driving force and the subsequent media sheet would stall between feed roll assembly 230 and exit roll assembly 360. Further with drive roll 360D on top would require that the pulling force needed by recycler roll assembly 310 to be greater that the drive force of drive roll 360D which could cause stretching or breaking of the top media sheet (first media sheet 214-1) in that it is being simultaneously pulled in opposite directions.

The directions of rotations of the drive roll 360D and idler roll 360I should not be construed as a limitation to the scope of the present disclosure.

In another aspect, the present disclosure provides a method for duplex processing of a pair of media sheets, such as first media sheet 214-1 and second media sheet 214-2, supported concurrently within a retractor and recycler system, such as retractor 300. The method is explained in conjunction with FIGS. 10A-10B while referring to retractor 300 and components thereof as depicted in FIGS. 3 to 9.

Figure 10A:
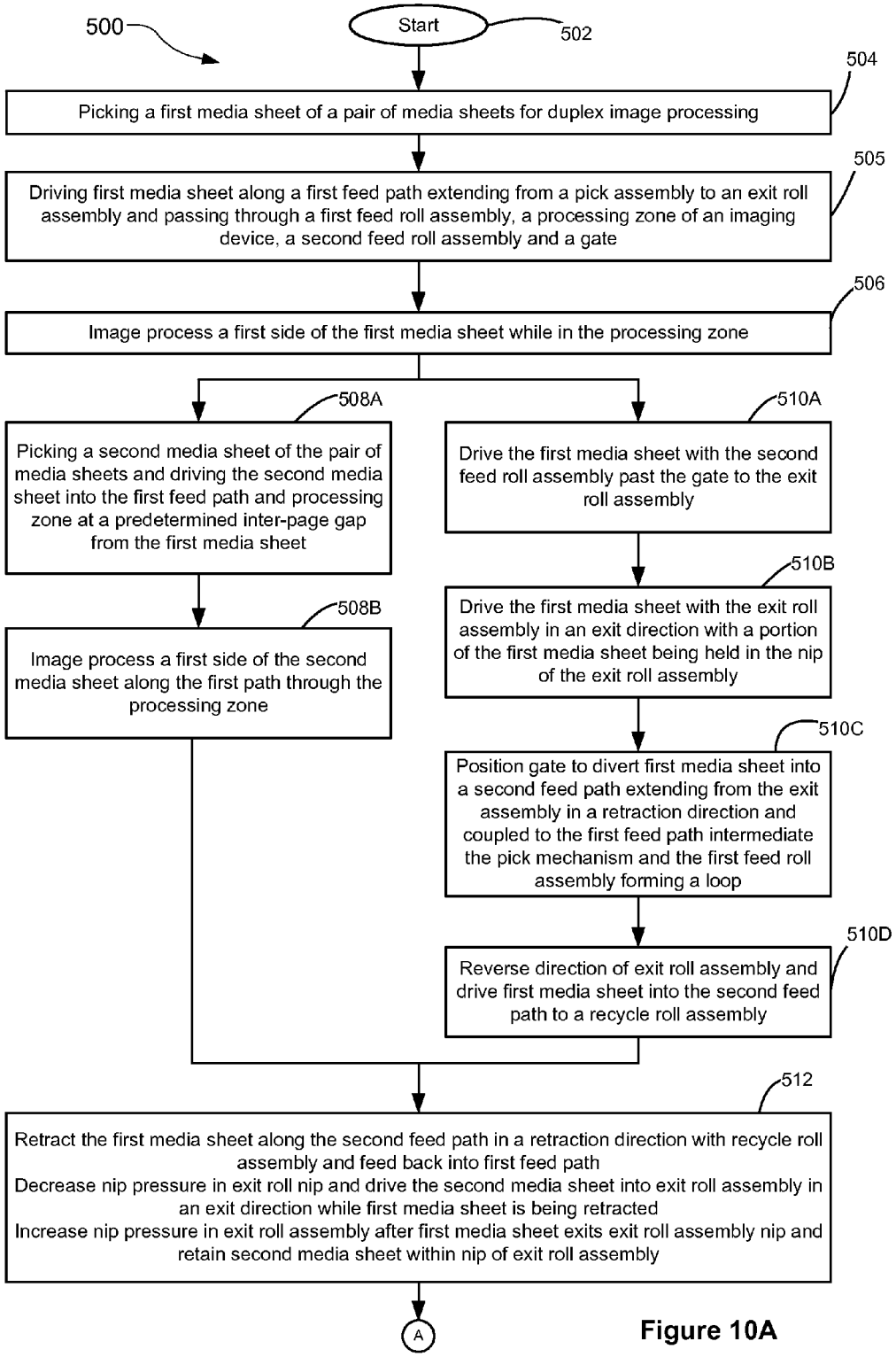
FIGS. 10A and 10B depict a flow chart for a method for duplex image processing of a pair of media sheets supported concurrently within the retractor and recycler of FIG. 3.
Figure 10B:
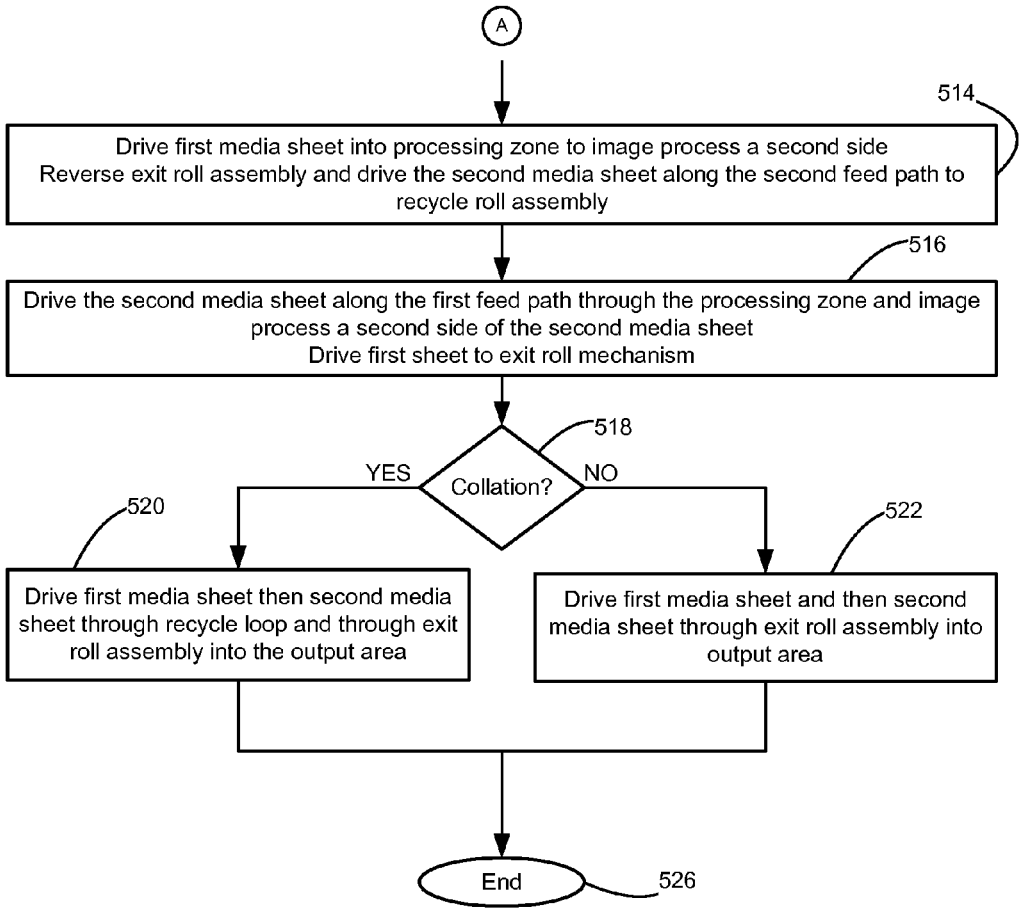

FIGS. 10A and 10B depict a flow chart for a method 500 for duplex image processing such, as scanning or printing, first media sheet 214-1 and second media sheet 214-2, supported concurrently within the retractor 300 and first media path 240 and second media path 242. At 502 the method 500 starts. Motor 270 may be activated to operate pick assembly 210, first feed roll assembly 220, second feed roll assembly 230 and recycler roll assembly 310 within retractor 300. At 504, first media sheet 214-1 of the pair of media sheets is picked for duplex image processing. Specifically, first media sheet 214-1 is picked by the pick assembly 210. At 505, first media sheet 214-1 is driven along first media path 240 through in turn first feed roll assembly 220 and into processing zone A for image processing at 506 a first side 12 of first media sheet 214-1 (as depicted in FIGS. 5 and 6). Actions at 508A and 508B occur concurrently or in parallel with actions at 510A-D as indicated by the parallel path in FIG. 10A. At 508A, second media sheet 214-2 is being picked and driven into first media path 240 at a predetermined inter-page gap G. At 508B, first side 22 of second media sheet is driven through processing zone A for image processing. At 510A first media sheet 214-1 is being driven by second feed roll assembly 230 toward exit roll assembly 360 and past diverter structure, e.g., gate 350. At 510B first media sheet 214-1 is driven in an exit direction E by exit roll assembly 360 with a portion of first media sheet 214-1 being held in nip 360N. At 510C, if diverter structure is gate 350 then gate 350 is positioned, either by controller 290 or by gravity, to divert first media sheet 214-1 into second media path 242. At 510D exit roll assembly 360 reverses direction and drives first media sheet 214-1 in retraction direction R into second media path 242 and to recycler roll assembly 310.

At 512, recycler roll assembly 310 continues retracting first media sheet 214-1 along second media path 242 in refraction direction R and feeds it back into first media path 240; nip pressure in nip 360N is decreased and second media sheet 214-2 is driven past diverter structure, e.g., gate 350 and into nip 360 by second feed roll assembly 230 (at this point both media sheets 214-1, 214-2 are in nip 360N moving in opposite directions); as first media sheet exits nip 360N nip pressure is increased so that second media sheet 214-2 may be held in nip 306N. At 514 first media sheet 214-1 is again driven through processing zone A to image process second side 14 while exit roll assembly 360 reverses and drives second media sheet 214-2 into second media path 242 and nip 310N of recycler roll assembly 310. At 516 second media sheet 214-2 is then driven around first media path 240 and second side 24 thereof is image processed while first media sheet 214-1 is driven in the exit direction E by exit roll assembly 360. At 518 a decision is made if collation is needed. If NO, at 522 first media sheet 214-1 then second media sheet 214-2 are sequentially driven by exit roll assembly 360 into output area 218 and the method ends at 526. If YES, then at 520 the recycling of first media sheet 214-1 and second media sheet 214-2 around a recycle path $L_2$ and out through exit roll assembly 360 into output area 218 occurs and then the method ends at 526. For the collation loop, image processing does not take place.

Several equivalent approaches can be used when recycler roll assembly is retracting a media sheet into second media path 242. One approach is to open nip 360N so that no nip pressure is applied to the media sheet being retracted. Another approach is to have nip 360N apply a pressure that is consistently lower than the retraction force provided by recycler feed roll assembly 310.

Although, the slightly increased dimensions of the recycler loop may lead to a small delay in facilitating passage of media sheets from the exit assembly 360 to first feed roll assembly 220 as opposed to prior art ADFs, the speed of motor 270 may be increased slightly to compensate for the delay in order to match the scanning speed with the speed of a print engine in an AIO.

Based on the foregoing, the present disclosure provides a retractor and recycler system, such as retractor 300, that is capable of supporting two media sheets (concurrently) for duplex image processing. By providing recycler roll assembly 310, throughput resulting from the use of such retractor and recycler system is nearly twice that of the previous existing designs.

The foregoing description of several embodiments of the present disclosure has been presented for purposes of illustration. It is not intended to be exhaustive or to limit the disclosure to the precise forms disclosed, and obviously many modifications and variations are possible in light of the above teaching. It is intended that the scope of the disclosure be defined by the claims appended hereto.

What is claimed is:

1. In an imaging device for a plurality of media sheets including a first media sheet and a second media sheet, the imaging device having a first media path and a second media path, the first media path having an entrance and an exit, the entrance of the first media path adjacent media input area having a pick assembly, the media input area having a length configurable between a predetermined minimum length Lmin and a predetermined maximum length Lmax, the exit of the first media path adjacent a media output area, the second media path intersecting the first media path at a first Y-shaped intersection adjacent the exit end of the first media path and intersecting the first media path at a second intersection adjacent the entrance of the first media path, the first and second media paths forming a recycle loop, the pick assembly operable to feed at least the first media sheet and the second media sheet into the first media path at a predetermined inter-page gap G for image processing, a media retractor and recycler system comprising:

a first drive mechanism;

a recycler roll assembly positioned adjacent the Y-shaped first intersection on a portion of the second media path that forms one arm of the Y-shaped first intersection and operatively connected with the first drive mechanism, the recycler roll assembly having a pair of opposed rolls forming a nip therebetween for receiving one of the first media sheet and then the second media sheets, the recycler roll assembly operable by the first drive mechanism to drive each of the first and then second media sheets along the second media path portion of the recycle loop toward the first media path portion of the recycle loop;

a reversible drive mechanism;

an exit roll assembly for concurrently supporting the first and second media sheets and positioned at the base of the Y-shaped first intersection, comprising:

an idler roll and a drive roll forming a nip therebetween;

the drive roll operatively connected with the reversible drive mechanism and rotatable in an exit direction when the reversible drive is rotating in first direction and rotatable in a retraction direction when the reversible drive rotates in a second direction opposite the first direction, the first and second media sheets when moving in the exit direction move into the output area and when moving in the retraction direction move into the second media path;

a nip positioner for adjusting a height of the nip of the exit roll assembly within a range between a closed position and an open position to allow for the first media sheet and the second media sheet to be simultaneously received in and movable through the exit roll assembly nip in opposite directions;

a diverter structure located immediately adjacent the first intersection, the diverter structure diverting one of the first media sheet and second media sheet into the second media path when one of the first and second media sheets are fed from the exit roll assembly in a retraction direction;

when the first and second media sheets are in an overlapping arrangement within the exit roll assembly, the recycler roll assembly nip applying when one of the first and second media sheets are in the recycler roll assembly nip a retraction force that is equal or greater than 1.5 times the sheet to sheet frictional force between the first and second media sheets and the first drive mechanism drives the recycler roll assembly feeding the one of the first and second media sheets in the recycler roll assembly nip in the retraction direction R into the second media path portion of the recycle loop while concurrently therewith the reversible drive mechanism drives the drive roll of the exit roll assembly feeding the other of the first and second media sheets into the media output area; and the idler roll of the exit roll assembly contacts the one of the first and second media sheet that is being retracted by recycler roll mechanism in the retraction direction R while drive roll of the exit roll assembly contacts and feeds the other of the first and second media sheets into the media output area.

2. The media retractor and recycler system of claim 1 wherein the recycle loop has a length that is less than 2Lmax and greater than Lmax.

3. The media retractor and recycler system of claim 2 wherein the recycle loop has a length that is approximately equal to Lmax plus two times the inter-page gap G plus a distance between the diverter structure and the exit roll assembly.

4. The media retractor and recycler system of claim 1 wherein the recycler roll assembly is positioned on the second media path at a distance from the first intersection that is less than the inter-page gap G.

5. The media retractor and recycler system of claim 1 wherein the idler roll of the exit roll assembly is positioned substantially vertically above the drive roll of the exit roll assembly.

6. The media retractor and recycler system of claim 1 wherein the nip positioner comprises a solenoid operably connected to one of the drive roll of the exit roll assembly, the idler roll of the exit roll mechanism and both the drive roll and exit roll of the exit roll mechanism.

7. The media retractor and recycler system of claim 1 wherein the diverter structure is a gravity operated gate that falls across the first media path.

8. The media retractor and recycler system of claim 1 wherein the diverter structure is placed at a predetermined distance from the exit roll assembly that is less than a length of a cantilevered portion of one of the first and second media sheet occurring when one of the first and second media sheets is being fed from the exit roll assembly into the second media path.

9. The media retractor and recycler system of claim 1 further comprising a feed roll assembly operably connected to the first drive mechanism for feeding one of the first and second media sheets along a portion of the first media path that forms the other arm of the Y-shaped first intersection toward the exit roll assembly, the feed roll assembly comprised of a pair of rolls forming a nip therebetween and located on a portion of first media path that forms the other arm of the Y-shaped first intersection.

10. The media retractor and recycler system of claim 9 wherein the feed roll assembly is positioned at a distance from the Y-shaped first intersection that is less than Lmin.

11. The media retractor and recycler system of claim 10 wherein the feed roll assembly is positioned at a distance from the Y-shaped first intersection that is greater than 2 times the inter-page gap G.

12. The media retractor and recycler system of claim 1 further comprising a second drive mechanism and a feed roll assembly operably connected to a second drive mechanism for feeding toward the exit roll assembly one of the first and second media sheets along a portion of the first media path that forms the other arm of the Y-shaped first intersection, the feed roll assembly comprised of a pair of rolls forming a nip therebetween.

13. The media retractor and recycler system of claim 12 wherein the feed roll assembly is positioned at a distance from the Y-shaped first intersection that is less than Lmin.

14. The media retractor and recycler system of claim 13 wherein the feed roll assembly is positioned at a distance from the Y-shaped first intersection that is greater than 2 times the inter-page gap G.

15. A method for image processing a pair of media sheets supported concurrently within a retractor and recycler system in an imaging device, the method comprising, picking from a media input area a first media sheet of the pair of media sheets for the duplex image processing;

driving the first media sheet along a first path extending from a pick assembly to an exit roll assembly of the retractor and recycler system and passing through a first feed roll assembly, a processing zone of the imaging device, a second feed roll assembly and a diverter structure device for scanning a first side of the first media sheet, image processing the first side of the first media sheet while in the processing zone;

concurrently performing:

picking from the media input storage area a second media sheet of the pair of media sheets and driving the second media sheet into the first media path and the processing zone at a predetermined inter-page gap G from the first media sheet;

image processing a first side of the second media sheet along the first path through the processing zone;

driving the first media sheet with the second feed roll assembly past the diverter structure to the exit roll assembly;

driving the first media sheet with the exit roll assembly in an exit direction with a portion of the first media sheet being held in a nip of the exit roll assembly;

using the diverter structure to divert the first media sheet into a second media path extending from the exit assembly in a retraction direction and coupled to the first media path intermediate the pick mechanism and the first feed roll assembly forming a recycle loop; and reversing the direction of the exit roll assembly and driving the first media sheet into the second media path and a recycler roll assembly;

retracting the first media sheet along the second media path in a retraction direction with the recycler roll assembly and feeding the first media sheet back into the first media path;

decreasing a nip pressure in the exit roll nip and driving the second media sheet into exit roll assembly in an exit direction while the first media sheet is being retracted from the exit roll assembly by the recycler roll assembly;

increasing nip pressure in the exit roll assembly nip after the first media sheet exits the exit roll assembly nip and retaining the second media sheet within the exit roll assembly nip;

driving the first media sheet into the processing zone and image processing a second side thereof;

reversing the exit roll assembly and driving the second media sheet along the second media path to the recycler roll assembly;

after the second media sheet is driven into the recycler roll assembly increasing the speed of the recycler roll assembly to decrease the inter-page gap G;

driving the second media sheet along the first media path through the processing zone and image processing a second side of the second media sheet while driving the first media sheet to the exit roll assembly; and determining if collation is needed and if so driving the first media sheet and then second media sheet into the second media path and first media path back to and through exit roll assembly to an output area, and if not driving the first media sheet and then the second media sheet through exit roll assembly into the output area.

16. The method of claim 15, wherein the imaging processing comprises scanning.

17. The method of claim 15, wherein the imaging processing comprises printing.

18. The method of claim 15, wherein decreasing the nip pressure in the exit roll assembly nip comprises actuating a solenoid operatively coupled to one of a drive roll in the exit roll assembly, an idler roller in the exit roll assembly, and both the drive roll and the exit roll of the exit roll assembly to increase the height of the exit roll assembly nip.

19. The method of claim 18, wherein increasing the nip pressure in the exit roll assembly nip comprises de-actuating the solenoid.

20. A method for image processing a pair of media sheets supported concurrently within a retractor and recycler system in an imaging device, the method comprising, picking from a media input area a first media sheet of the pair of media sheets for the duplex image processing;

driving the first media sheet along a first path extending from a pick assembly to an exit roll assembly of the retractor and recycler system and passing through a first feed roll assembly, a processing zone of the imaging device, a second feed roll assembly and a diverter structure device for scanning a first side of the first media sheet, image processing the first side of the first media sheet while in the processing zone;

concurrently performing:

picking from the media input storage area a second media sheet of the pair of media sheets and driving the second media sheet into the first media path and the processing zone at a predetermined inter-page gap G from the first media sheet;

image processing a first side of the second media sheet along the first path through the processing zone;

driving the first media sheet with the second feed roll assembly past the diverter structure to the exit roll assembly;

driving the first media sheet with the exit roll assembly in an exit direction with a portion of the first media sheet being held in a nip of the exit roll assembly;

using the diverter structure to divert the first media sheet into a second media path extending from the exit assembly in a retraction direction and coupled to the first media path intermediate the pick mechanism and the first feed roll assembly forming a recycle loop; and reversing the direction of the exit roll assembly and driving the first media sheet into the second media path and a recycler roll assembly;

retracting the first media sheet along the second media path in a retraction direction with the recycler roll assembly and feeding the first media sheet back into the first media path;

decreasing a nip pressure in the exit roll nip and driving the second media sheet into exit roll assembly in an exit direction while the first media sheet is being retracted from the exit roll assembly by the recycler roll assembly;

increasing nip pressure in the exit roll assembly nip after the first media sheet exits the exit roll assembly nip and retaining the second media sheet within the exit roll assembly nip;

driving the first media sheet into the processing zone and image processing a second side thereof;

reversing the exit roll assembly and driving the second media sheet along the second media path to the recycler roll assembly;

while the second media sheet is being fed from the exit roll assembly to the recycler roll assembly increasing the speed of the exit roll assembly to decrease the inter-page gap G;

driving the second media sheet along the first media path through the processing zone and image processing a second side of the second media sheet while driving the first media sheet to the exit roll assembly; and determining if collation is needed and if so driving the first media sheet and then second media sheet into the second media path and first media path back to and through exit roll assembly to an output area, and if not driving the first media sheet and then the second media sheet through exit roll assembly into the output area.

21. The method of claim 20, wherein the imaging processing comprises scanning.

22. The method of claim 20, wherein the imaging processing comprises printing.

23. The method of claim 20, wherein decreasing the nip pressure in the exit roll assembly nip comprises actuating a solenoid operatively coupled to one of a drive roll in the exit roll assembly, an idler roller in the exit roll assembly, and both the drive roll and the exit roll of the exit roll assembly to increase the height of the exit roll assembly nip.

24. The method of claim 23, wherein increasing the nip pressure in the exit roll assembly nip comprises de-actuating the solenoid.

* * * * *